US005259341A

United States Patent [19]

Person

[11] Patent Number: 5,259,341

[45] Date of Patent: Nov. 9, 1993

[54] HYDRO INJECTION STEAM GENERATOR

[75] Inventor: Thomas C. Person, St. Louis, Mo.

[73] Assignee: Allbrand Service, Inc., St. Louis, Mo.

[21] Appl. No.: 986,115

[22] Filed: Dec. 4, 1992

[51] Int. Cl.[5] ..... F22B 1/02

[52] U.S. Cl. ..... 122/31.1; 122/32; 122/34; 122/40

[58] Field of Search ..... 122/31.1, 31.2, 32, 122/34, 39, 40, 504, 406.5, 487

[56] References Cited

U.S. PATENT DOCUMENTS

| | | | |
|---|---|---|---|
| 4,164,202 | 8/1979 | Lockett, Jr. | 122/31.1 |
| 4,326,581 | 4/1982 | Rapier | 122/31.1 |
| 4,799,538 | 1/1989 | Dugand et al. | 122/34 |
| 5,086,731 | 2/1992 | Lockett et al. | 122/31.2 |

*Primary Examiner*—Henry C. Yuen
*Attorney, Agent, or Firm*—Veo Peoples

[57] ABSTRACT

A hydro injection system for generating steam from the heat exchanged between a stream of hot combustion gases and a countercurrent flow of warm water sprays which contact hot tubes transporting the hot combustion gases is disclosed. The system comprises i. a continuous supply of hot combustion gases and means for propelling the gases through the system;

ii. a continuous supply of cold water and means for warming said cold water prior to steam generation;

iii. a pressure vessel means for conducting the heat exchange; and iv. a condensate receiver means for recirculating and equilibrating water in the system.

1 Claim, 4 Drawing Sheets

HYDRO INJECTION STEAM GENERATOR

BACKGROUND OF THE INVENTION

1. Field of the Invention

This invention relates to steam generators and systems for generation of steam; more particularly, it relates to a system for injecting water into a pressurized heat exchange zone in the form of a patterned spray at heated equilibrium which is converted to steam.

2. The Prior Art

In the past, commercial and/or household steam heat has been generated by bringing large volumes of still water to boiling temperatures within large jacketed vats. However, such steam-generating units require substantial space and substantial energy per volume of steam.

Injection of atomized water into pressurized containers which simultaneously generate steam has not been employed for commercial and household heating because such systems have serious drawbacks.

U.S. Pat. No. 4,800,848 describes a system for water injection into internal combustion engines. However, said system is extremely restrictive with regard to mixing of injected water and steam. Adapting such system to produce sufficient heat and sufficient volume of steam for application to radiated environmental heat within a household or commercial establishment has not been attempted.

U.S Pat. No. 4,989,551 describes the problems associated with the start-up of steam-generating equipment when there is a possibility of slugs of cold water which could be driven into hot steam chambers. When the temperature differential between water and steam is too diverse, and the volume and rate at which such steam must be generated is great, the intermixing multiphase flow can result in a reaction having violent effects on the associated piping system. This reaction is said to be largely due to condensate shock originating from a cold portion of the system being driven into a steam header which has reached operating temperatures. An example of such problems occurs in the steam generators used in the field of secondary petroleum recovery. Although U.S. Pat. No. 4,989,551 discloses the use of a water-diffusion plate for injecting water into such steam headers, this system uses normal boilers for the original source of steam. The system merely serves to augment the volume of steam within a header. Until now, no means had been discovered for containing and controlling condensation shock at an original steam generator.

SUMMARY OF THE PRESENT INVENTION

It is an object of the present invention to provide an original steam generator which negates the need to heat large volumes of cold water in static fashion. For example, 600,000 BTU's per hr. at 2500 sq. ft. of steam at 215° F. can be achieved by the process of this invention.

It is a further object of the present invention to contain a dynamic countercurrent flow of water spray against a stream of hot combustion gases from potential explosive condensation shock, when the water spray generates steam at a rate of 41,667 sq. ft. per hour=10,000,000 BTU's.

These objects and others are fulfilled by constant circulation of condensate intermixed with cold make-up water, which is heated twice by, and sprayed once onto, a countercurrent flow of hot combustion gases. We have discovered that an intrinsic equilibrium occurs which enables substantial reduction in the size of steam generators as, for example, boilers and which results in substantial improvement in the efficiency of steam generation.

DESCRIPTION OF THE ILLUSTRATED EMBODIMENTS

Figure 1:
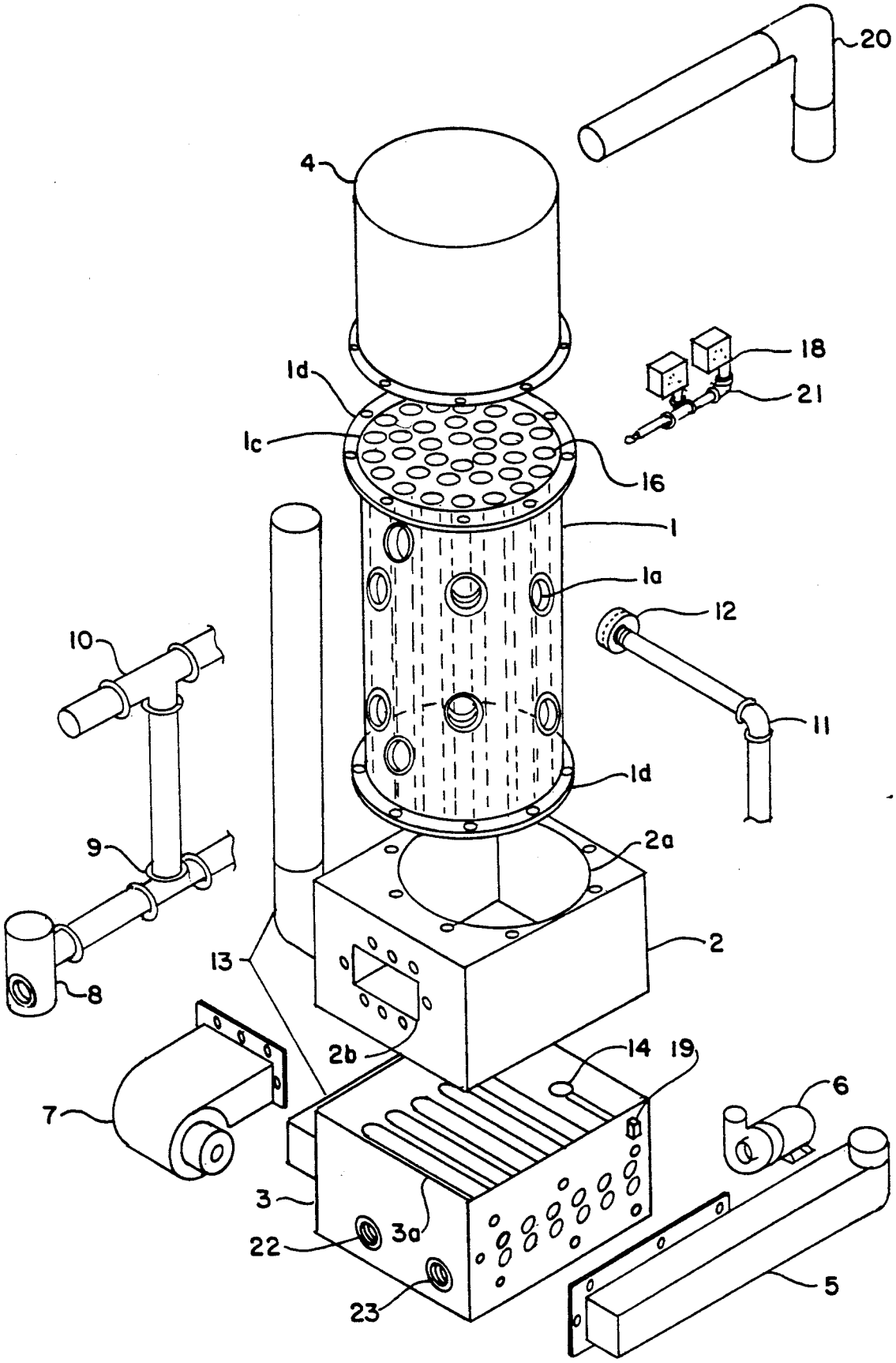
FIG. 1 is a perspective view of disassembled portions of an embodiment of the present invention.
Figure 3:
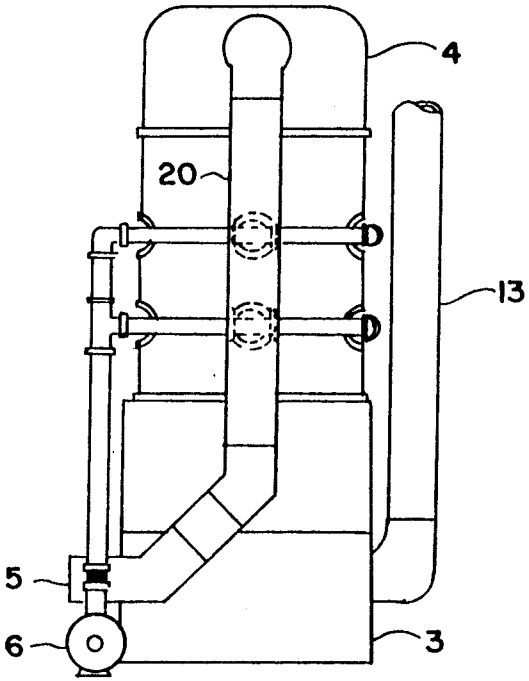
FIG. 3 is a back view of the fully assembled embodiment of the invention.

FIG. 1 illustrates the parts of one embodiment of the Applicant's invention, positioned for assembly, which when fully assembled may be more readily understood by referring to FIGS. 2, 3, 4 and 5. The hydro injection steam generation system so illustrated comprises a number of components. A first intake manifold 4 for receiving and collecting hot combustion gases from the pressure vessel 1 is mounted atop one end of said pressure vessel. A conduit means 20 opens into said first manifold 4 for purposes of transporting combustion gases to the second manifold 5 into which said conduit 20 also opens. A plurality of tubes 1B are longitudinally affixed within the pressure vessel 1 for the purposes of containing and transporting hot combustion gases from a firebox 2, throughout the length of the pressure vessel 1 and into the first manifold 4. The vessel 1 further comprises a series of apertures 1A patterned all around its walls for receiving and fixing spray means 12. The spray means 12 are connected to conduit means 11 so as to allow a flow of water to be sprayed countercurrently against the walls of the tubes 1B. Tube sheets 1C may be fitted at each end of the vessel 1 for the purpose of fixing the tubes 1B. Each tube sheet may be mounted underneath a flange 1B. Underneath the vessel 1 a firebox 2 is mounted to the flange. Firebox 2 has an opening 2A into the vessel and an opening 2B. A means 7 for generating and propelling hot combustion gases through the firebox by way of opening 2B and up through opening 2A into the tubes 1B is mounted to the combustion firebox 2 at the opening 2B. Mounted underneath the combustion firebox 2 is a condensate receiver 3 for receiving and intermixing cold water and condensate while also serving to establish temperature equilibrium of the cold water and condensate.

Figure 2:
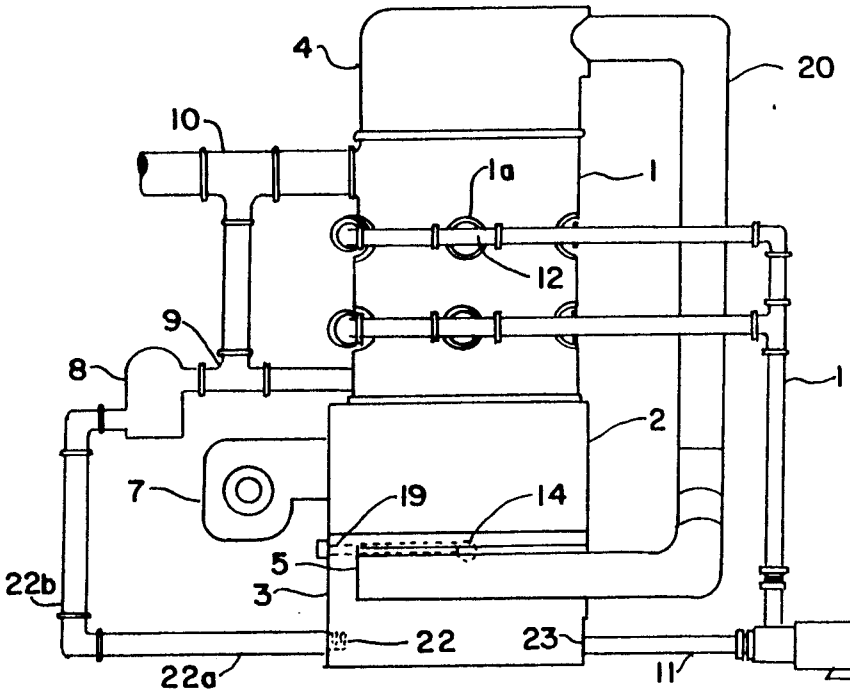
FIG. 2 is a right side view of the embodiment of the present invention fully assembled.
Figure 8:
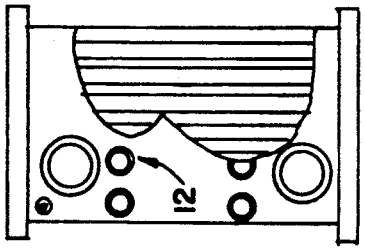
FIG. 8 is a frontal and partially cut-away view of a pressure vessel means for the present invention.
Figure 9:
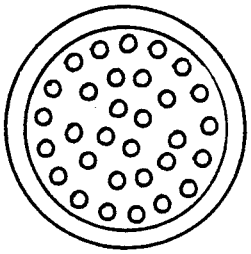
FIG. 9 is a top view of a pressure vessel means for the present invention.
Figure 10:
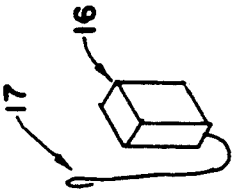
FIG. 10 is a perspective view of a boiler microprocessor and attached thermister sensing device for high temperature control of the present invention.
Figure 6:
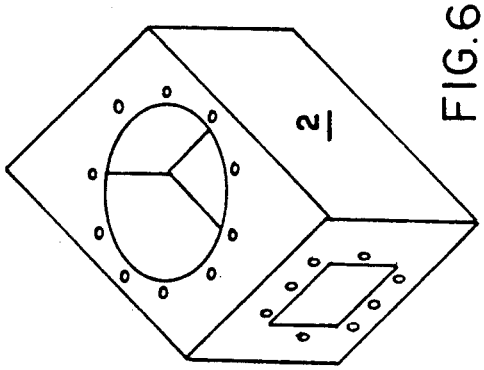
FIG. 6 is a perspective view of a combustion firebox, without a combustion gas generating means.
Figure 7:
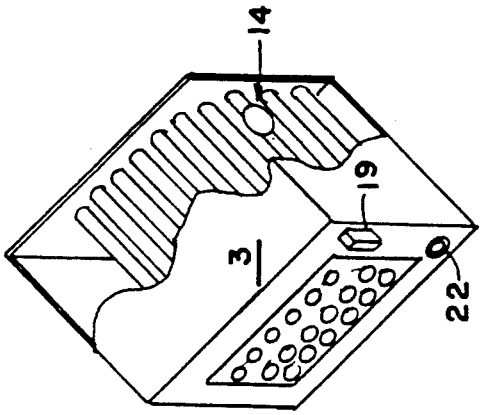
FIG. 7 is a perspective and partially exposed view of a condensate receiver means for the present invention.
Figure 5:
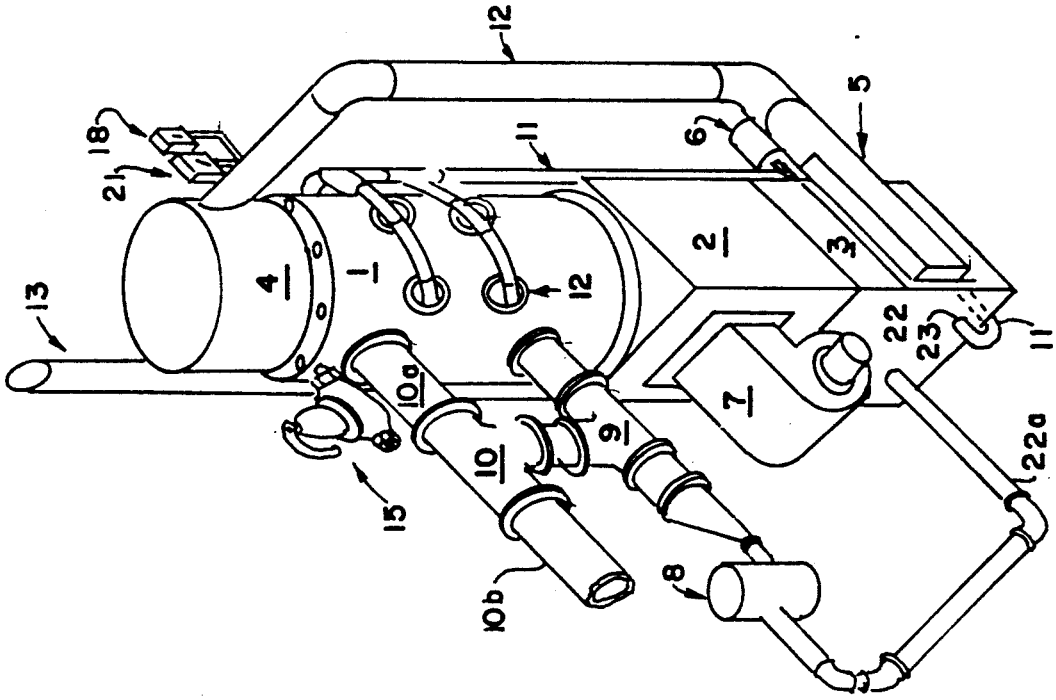
FIG. 5 is a perspective view of the fully assembled embodiment of the present invention.
Figure 11:
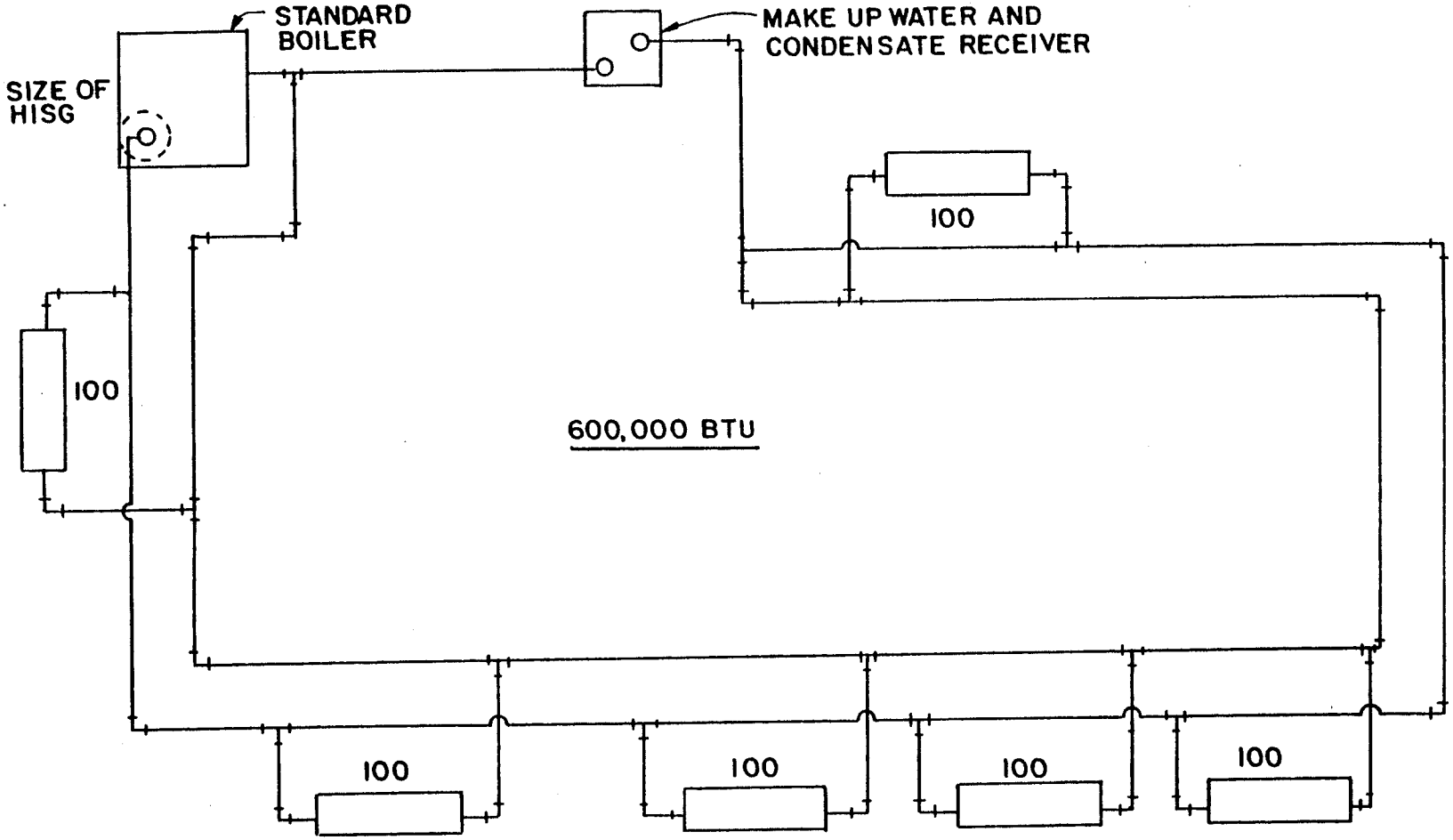
FIG. 11 is a block diagram of the system of the present invention showing the comparative size differential between the injection steam generator of the present invention and a standard boiler.

The condensate receiver 3 contains a plurality of lateral tubes 3A which open at one end into a second manifold 5, mounted to that end of the condensate receiver 3. The second manifold 5 is connected to the conduit 20 so as to receive combustion gases flowing from the first manifold 4, and transported by the conduit 20. The lateral tubes 3A open at their opposite end into conduit 13, which is more readily shown in FIG. 3, and such gases flow through conduit 13 out of the system by way of, for example, a chimney. The condensate receiver 3 also contains two apertures 22 and 23 in its wall. The aperture 22 serves as an inlet for condensate admixed with make-up water. Mounted to aperture 22 is conduit 22A which, as can be seen more readily from FIG. 5, is connected to bucket trap 8 which is used to separate steam from the water that has not been converted to steam. Bucket trap 8 is also connected to a Tee-fitting 9 which is connected to the wall of vessel 1 through an opening that allows water droplets to be received which had failed to convert to steam and to flow through Tee-fitting 9 into bucket trap 8, which traps the steam and thereafter the condensate flows through conduit 22A into the condensate receiver 3. Also connected to the Tee-fitting 9 is a Tee-fitting 10 for equalizing pressure. Tee-fitting 10 receives a conduit 10A that opens into the vessel 1 for purposes of carrying steam generated within vessel 1 through the Tee-fitting 10 and on through conduit 10B towards radiators 100, as seen in FIG. 11. Conduit 22B as seen in FIG. 2 may be connected into conduit 22A from a source of make-up water. The aperture 23 is also connected in a wall of the condensate receiver at any position which would allow the outflow of water and condensate. FIG. 1 illustrates aperture 23A in the same wall as aperture 22. FIG. 2 illustrates, however, that aperture 23 may also be in the wall opposite to aperture 22. Aperture 23 is connected to conduit 11 for the outflow of water into pump 6 and on through the continuation of conduit 11 in order to transfer water from the condensate receiver to the vessel spray means 12.

A float switch 14 is preferably connected to the condensate receiver 3 to maintain the water level. The purpose of switch 14 is to start the make up water condensate receiver in FIG. 16. When the water level is low, a float within the switch 14 lowers causing the switch 14 to close the circuit in the connection box 19, energizing the pump 6, which pumps water in the condensate receiver 3. A steam pressure relief valve 15, as depicted in FIG. 2, may be set in the vessel 1. The valve 15 is preset at about 15 psig for safety relief Normal operation will be at 5 psig. A boiler saver microprocessor 16 may be connected to the system thermister 17 which is placed in the wall of the vessel 1 as a means for sensing the temperature of the vessel, which may be monitored from the microprocessor 16. The microprocessor may be programmed to shut the system down if the temperature in the vessel exceeds a predetermined danger point.

Figure 4:
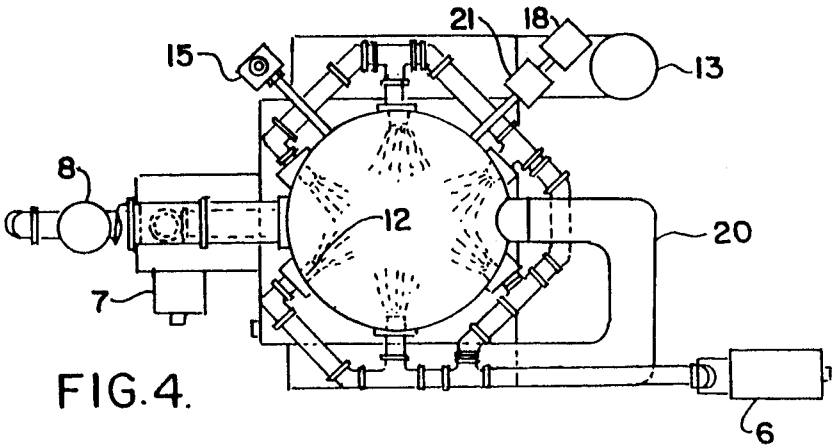
FIG. 4 is a top view of the fully assembled embodiment of the present invention, including an active water spray.

A steam pressure switch 18 and steam pressure gauge 21, as seen in FIG. 5 and in FIG. 4, may be connected to the vessel. This switch 18 regulates steam pressure at a setting on low pressure steam from 0 to 5 psig or high pressure up to 75 psig. The gauge 21 allows visual observance of pressure changes. An electrical connection box 19 for controlling the float switch 14 and closing the flow of water from conduit 22 or for shutting down the condensate receiver as depicted in FIG. 11. The box 19 contains contact terminals for electrical connection to the float switch 14.

What is claimed is:

1. A hydro injection system for generating steam comprising:

a. a continuous supply of hot combustion gases to serve as a heat exchange media;

b. a first intake manifold for collecting and transmitting the combustion gas;

c. a pressure vessel mounted to said manifold and containing a plurality of tubes to receive the combustion gases transmitted from the manifold, said vessel further comprising inner walls having a patterned array of apertures constructed therein for injection of water spray by dispensing a patterned series of water sprays onto the tubes of hot gas and generating steam therefrom, said vessel also having a first opening in its wall for outtake of the steam generated within the vessel and a second opening for outtake of residual water droplets which fail to vaporize into steam;

d. a combustion firebox mounted to said vessel at a position opposite from the manifold, said combustion firebox serving to house a power burner for generating the combustion gases and having a means for propelling said gases throughout the system;

e. a condensate receiver mounted to said combustion firebox at a position opposite from the pressure vessel, said condensate receiver having a first aperture for intake of water droplets or condensate from the pressure vessel and from a make-up tank, a second aperture for outflow of the condensate to the pressure vessel, a float switch to the condensate level, said condensate receiver also having a plurality of inner tubes which open through a wall of the condensate receiver into a second manifold;

f. said second manifold having connected thereto a conduit for transporting combustion gas from the condensate receiver to the first manifold;

g. a conduit extending from the outflow aperture in the condensate receiver to a circulation pump and from the circulation pump to the series of apertures in the pressure vessel for injection of water spray;

h. a conduit extending from the intake aperture of the condensate receiver to the first and second openings of the pressure vessel for purposes of receiving water droplets or condensate from said pressure vessel and transporting same to the condensate receiver.

* * * * *